US011145153B2

(12) United States Patent
Chisholm et al.

(10) Patent No.: US 11,145,153 B2
(45) Date of Patent: Oct. 12, 2021

(54) EJECTOR SYSTEM FOR DISPENSING MACHINES

(71) Applicant: WM. WRIGLEY JR. COMPANY, Chicago, IL (US)

(72) Inventors: Keith A. Chisholm, Chicago, IL (US); Liu Kaiguo, Hong Kong (HK); Lu Jianmin, Hong Kong (HK)

(73) Assignee: WM. WRIGLEY JR. COMPANY, Chicago, IL (US)

( * ) Notice: Subject to any disclaimer, the term of this patent is extended or adjusted under 35 U.S.C. 154(b) by 0 days.

(21) Appl. No.: 16/896,453

(22) Filed: Jun. 9, 2020

(65) Prior Publication Data

US 2020/0312079 A1 Oct. 1, 2020

Related U.S. Application Data

(62) Division of application No. 16/301,955, filed as application No. PCT/US2017/033259 on May 18, 2017, now abandoned.

(60) Provisional application No. 62/339,613, filed on May 20, 2016.

(51) Int. Cl.

| | |
|---|---|
| ***G07F 11/12*** | (2006.01) |
| ***G07F 11/10*** | (2006.01) |
| ***G07F 11/04*** | (2006.01) |

(52) U.S. Cl.

CPC ..... *G07F 11/12* (2013.01); *G07F 11/04* (2013.01); *G07F 11/10* (2013.01)

(58) Field of Classification Search

None

See application file for complete search history.

(56) References Cited

U.S. PATENT DOCUMENTS

| | | | | |
|---|---|---|---|---|
| 3,342,373 | A * | 9/1967 | Weitzman | G07F 11/12 221/107 |
| 4,673,105 | A | 6/1987 | Kurosawa et al. | |
| 5,316,124 | A | 5/1994 | Barnes | |
| 5,651,476 | A * | 7/1997 | Percy | G07F 11/04 221/123 |
| 6,431,395 | B1 | 8/2002 | San Martin | |

(Continued)

FOREIGN PATENT DOCUMENTS

| | | | |
|---|---|---|---|
| JP | 06314370 | A | 11/1994 |
| JP | 07296245 | A | 11/1995 |
| JP | 0922485 | A | 1/1997 |

(Continued)

*Primary Examiner* — Kavel Singh

(57) ABSTRACT

A product storage column for a dispensing machine includes a first member having a substantially U-shaped cross-section. The first member includes a first side wall opposing a second side wall, and both side walls extend from a back wall toward a front plane opposite the back wall. The side walls, the back wall, and the front plane cooperate to define a product space therewithin. The product storage column also includes a second member rotatably coupled to the first side wall and selectively positionable relative to the first member between an opened position and a closed position. The first member is sized to receive a product through the front plane into the product space when the second member is in the opened position, and the second member is sized to prevent movement of the product through the front plane when the second member is in the closed position.

11 Claims, 8 Drawing Sheets

(56) References Cited

U.S. PATENT DOCUMENTS

| | | | | |
|---|---|---|---|---|
| 6,789,996 | B2 * | 9/2004 | Yuyama | G07F 17/0092 414/798.1 |
| 9,589,412 | B2 * | 3/2017 | Shimmerlik | G07F 9/10 |

FOREIGN PATENT DOCUMENTS

| | | | |
|---|---|---|---|
| JP | H10261144 | A | 9/1998 |
| JP | 3360514 | B2 | 12/2002 |
| JP | 5263892 | B2 | 5/2013 |

* cited by examiner

EJECTOR SYSTEM FOR DISPENSING MACHINES

BACKGROUND OF THE INVENTION

The field of the disclosure relates generally to a dispensing machine for dispensing products to consumers, and more specifically to a product column and an ejector system for use with dispensing machines.

Dispensing machines are widely used for the dispensing of various products, e.g. small packaged foods, confectionary products, and novelty items. The dispensing machines are typically installed in public or common areas, such as in train stations and office buildings. Additionally, the dispensing machines tend to be large in size which requires a designated room or area to accommodate a large footprint. The large footprint may limit a number of dispensing machines that can be placed in a given common or public area, or even prevent the placement of the dispensing machines in certain areas, thus reducing the opportunity for consumers to purchase selected products from the dispensing machine.

Smaller dispensing machines are known to reduce the footprint of the machine such that the dispensing machines may be placed in more areas. At least some smaller dispensing machines, however, eject the purchased product forward from a stacked storage location, such that the product has to clear a front plate to reach a consumer retrieval area of the machine. The front-to-back size of the dispensing machine is increased because the product has to clear the front plate to reach the retrieval area. Furthermore, smaller dispensing machines may require greater frequency and time to refill/restock. At least some smaller dispensing machines include a stacked storage location wherein the products are loaded from the top of a column, increasing a likelihood that products will become skewed within the column before reaching the bottom during loading. For example, an individual loading the product column may be required to carefully guide the first one to two products manually from the top to the bottom of the column to make sure they are not skewed, thereby increasing a time required to load the machine and, correspondingly, a cost of operating the machine. As such, a number of challenges have yet to be completely addressed in the marketplace and improvements are desired.

BRIEF DESCRIPTION OF THE INVENTION

In one aspect, a product storage column for a dispensing machine is provided. The product storage column includes a first member having a substantially U-shaped cross-section. The first member includes a first side wall opposing a second side wall, and both side walls extend from a back wall toward a front plane opposite the back wall. The side walls, the back wall, and the front plane cooperate to define a product space therewithin. The product storage column also includes a second member rotatably coupled to the first side wall and selectively positionable relative to the first member between an opened position and a closed position. The first member is sized to receive a product through the front plane into the product space when the second member is in the opened position, and the second member is sized to prevent movement of the product through the front plane when the second member is in the closed position.

In another aspect, a method of filling a product storage column for a dispensing machine is provided. The product storage column includes a first member having a substantially U-shaped cross-section. The first member includes a first side wall opposing a second side wall, and both side walls extend from a back wall toward a front plane opposite the back wall. The side walls, the back wall, and the front plane cooperate to define a product space therein. The product storage column further includes a second member rotatably coupled to the first side wall. The method includes selectively positioning the second member to an opened position relative to the first member, inserting a product through the front plane into the product space, and selectively positioning the second member to a closed position relative to the first member. The second member is sized to prevent movement of the product through the front plane when the second member is in the closed position.

In a further aspect, an ejector system for a dispensing machine is provided. The ejector system includes a support base including a support surface configured to receive a first and a second column of product packages adjacent the support surface. The ejector system also includes a first dispensing block sized to substantially correspond to a size of a product package to be dispensed. The first dispensing block is movably coupled to the support base. The ejector system further includes a second dispensing block sized to substantially correspond to the size of the product package. The second dispensing block is movably coupled to the support base adjacent to the first dispensing block. Each of the first and second dispensing blocks is selectively positionable through a cycle of positions relative to the support surface to eject a series of the product packages from the first and second product package columns.

In yet another aspect, a method for ejecting a series of product packages from a dispensing machine using an ejector system is provided. The ejector system includes a support base and first and second dispensing blocks. The first and second dispensing blocks are adjacent each other, and each is sized to substantially correspond to a size of one of the product packages. Each of the first and second dispensing blocks is movably coupled to the support base. A support surface of the support base is configured to receive a first and a second column of product packages adjacent the support surface. The method includes selectively positioning the first and second dispensing blocks through a cycle of positions relative to the support surface to eject the series of product packages from the first and second product package columns.

BRIEF DESCRIPTION OF THE DRAWINGS

Non-limiting and non-exhaustive embodiments are described with reference to the following Figures, wherein like reference numerals refer to like parts throughout the various views unless otherwise specified.

DETAILED DESCRIPTION OF THE INVENTION

Dispensing machines, for example vending machines, tend to be located within public or common areas. As such, decreasing the overall footprint of the machine tends to increase the number of areas that may include the dispensing machine. Smaller size dispensing machines, also known as micro-vending machines, provide for a machine that may be located in many different areas. Thus, reducing the size of dispensing machines facilitates a more versatile machine. The smaller size, however, increases the frequency of restocking the dispensing machine, which may be time consuming and thus more costly. Thus, decreasing stocking time for the dispensing machines also facilitates a more versatile machine.

Improved systems and methods for a dispensing machine are therefore described below. Specifically, an improved quick loading, stack-based product storage column for the dispensing machine is provided. The product storage column includes a member that is hinged, such that the storage column may be opened for product insertion along a vertical axis of the column. This product storage column facilitates a quicker stocking time, and also decreases a likelihood of turning or skewing the product within the storage column, as compared to loading product from a top opening of the storage column. Further, an improved multi-stage ejector system for a dispensing machine is described below. The ejector system includes a support base and a first and second dispensing block. Each of the dispensing blocks is movably coupled to the support base and selectively positionable relative to the support base such that a series of product packages may be ejected therefrom. In certain embodiments, the ejector system is operable to eject product packages from the side of the ejector instead of the front, thus decreasing a front-to-back width of the ejector and facilitating a slimmer dispensing machine. In addition, both the product storage column and the ejector system may be used for products, such as the confectionary product described above, which are stacked in two columns of product within a single storage column, such that only a single package is dispensed in each vending operation.

Figure 1:
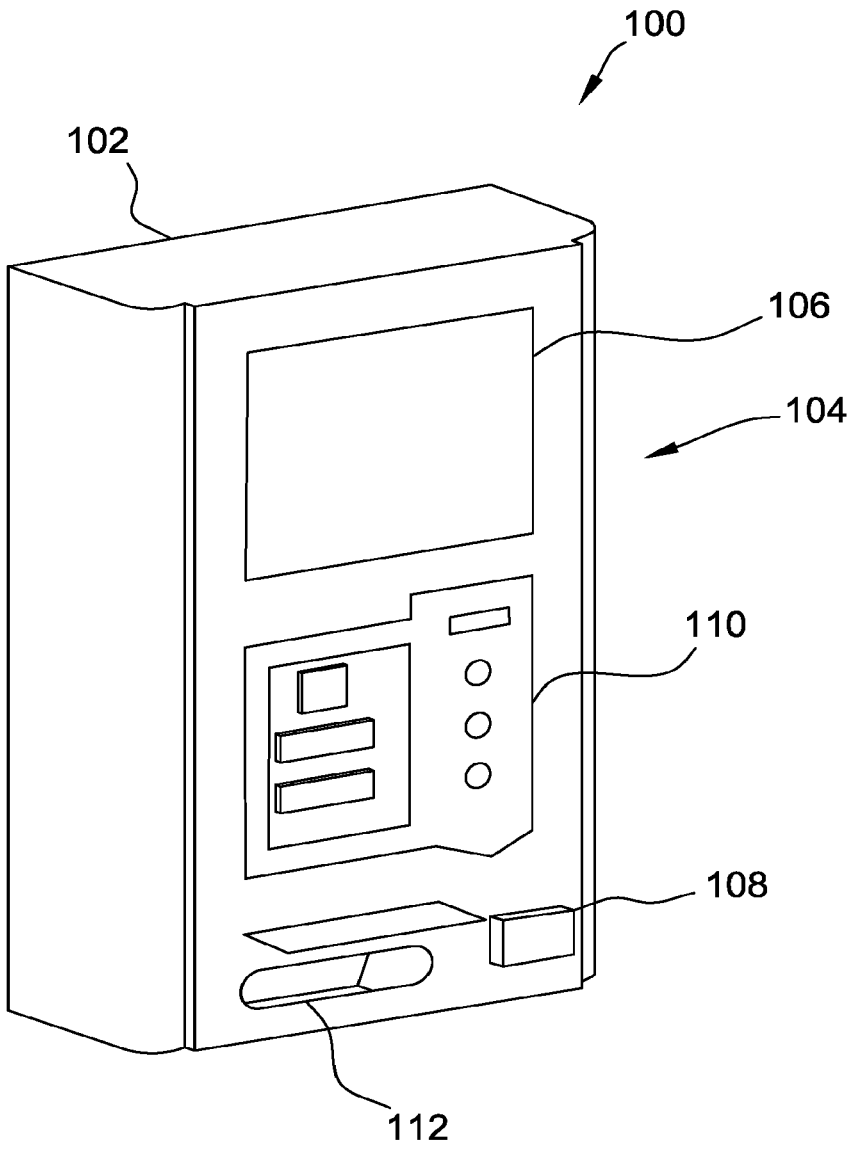
FIG. 1 is a perspective view of an exemplary dispensing machine.

FIG. 1 is a perspective view of an exemplary dispensing machine 100. In the exemplary embodiment, the dispensing machine 100 includes a cabinet 102 retaining a plurality of products to be dispensed. On an outer face of the cabinet a consumer interface 104, including various means for a consumer to interact with the machine 100, is provided. For example, the consumer interface 104 includes a video display 106, a payment (e.g. cash and/or payment card) acceptor 108, and selection buttons 110. Furthermore, a product retrieval channel 112 is positioned within a lower portion of the dispensing machine 100. In alternative embodiments, the video display 106 may include a control display interface.

In operation, a consumer (not shown) uses the consumer interface 104 to browse available products located next to the selection buttons, select a product to purchase, and pay for the purchase. The selected product then is provided within the product retrieval channel 112 for the consumer to retrieve. It should be appreciated that exemplary consumer interface 104 may alternatively be any other system/interface that enables dispensing machine 100 to function as described herein.

Figure 2:
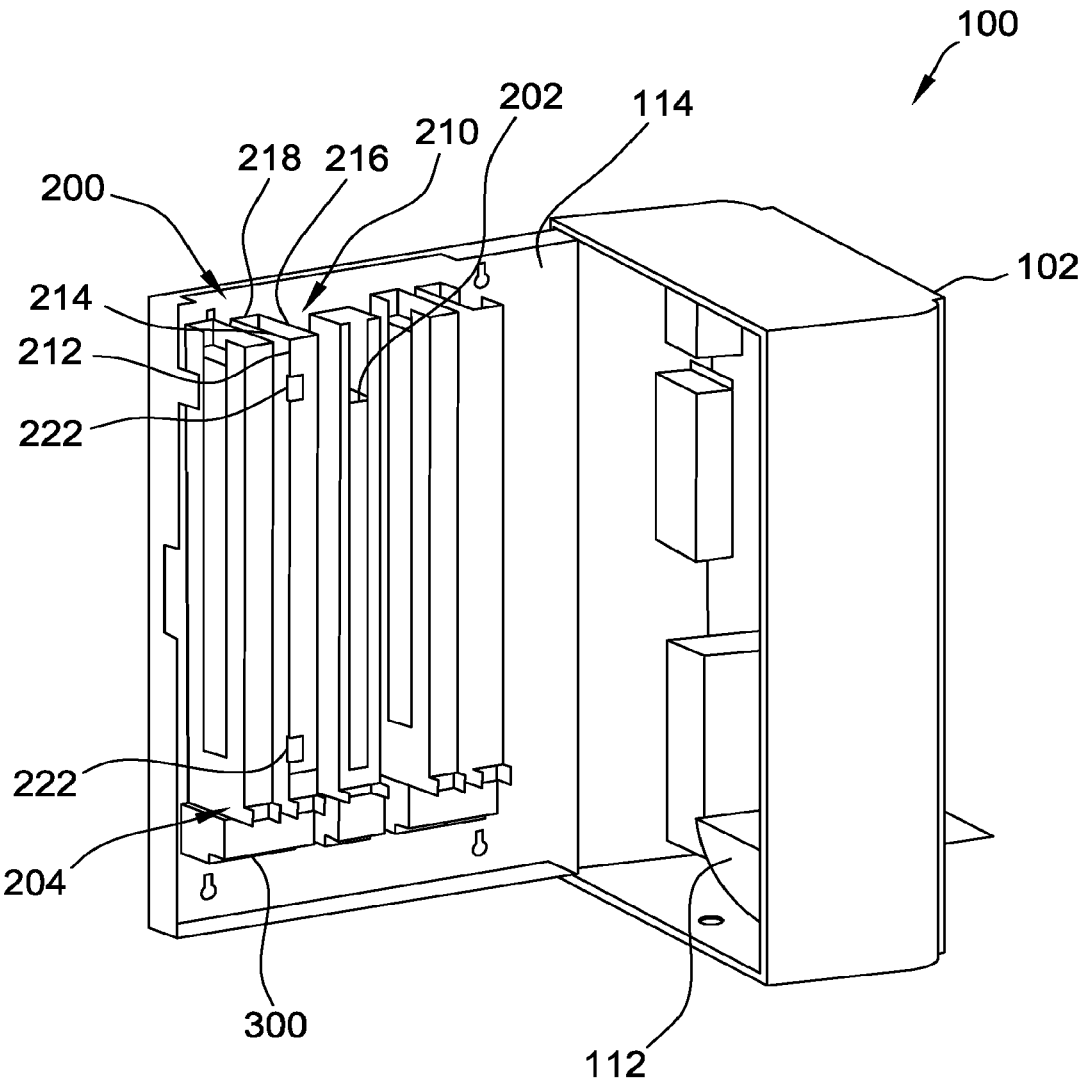
FIG. 2 is a perspective view of an interior of the dispensing machine shown in FIG. 1, with an exemplary product storage column in a closed position.
Figure 3:
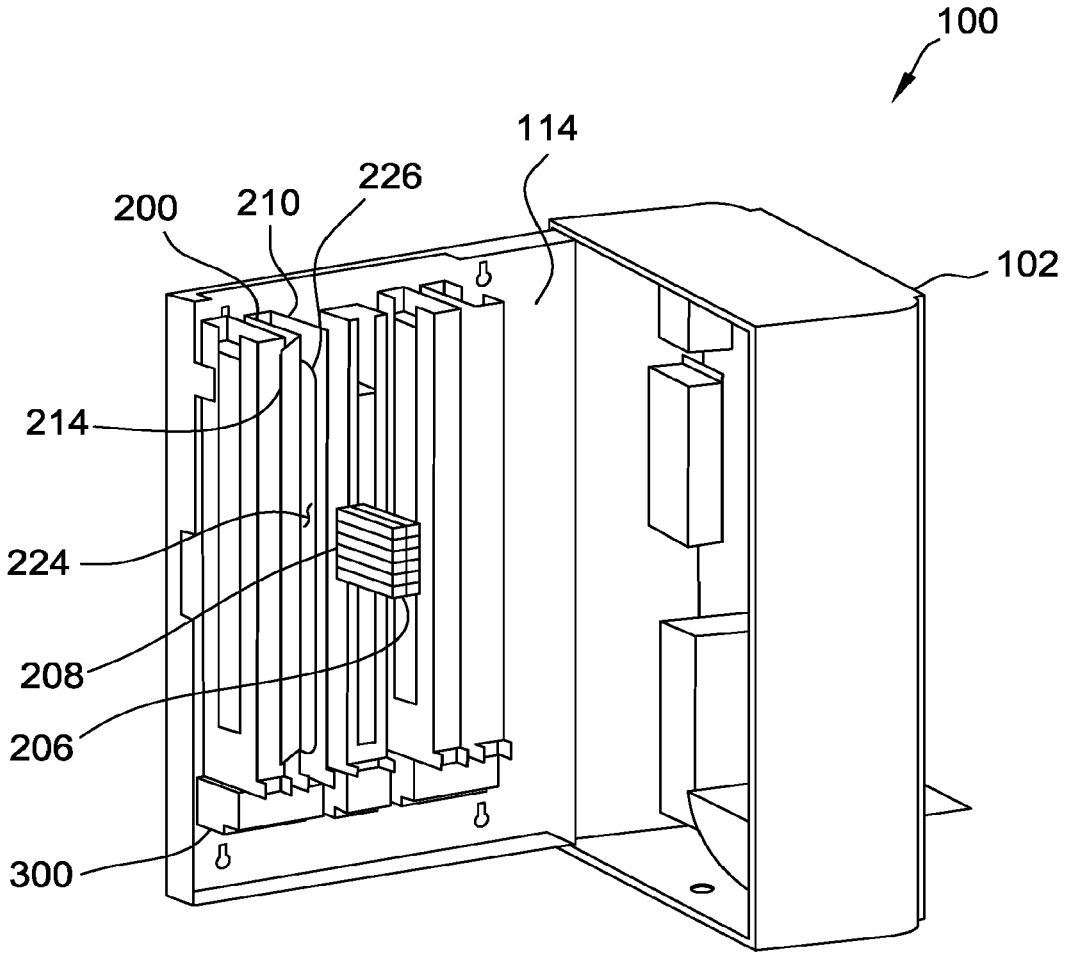
FIG. 3 is a perspective view of the product column shown in FIG. 2 in an exemplary opened position.

FIG. 2 is a perspective view of an interior of dispensing machine 100 (shown in FIG. 1), with an exemplary product storage column 200 in an exemplary closed position. FIG. 3 is a perspective view of the product storage column 200 shown in FIG. 2 in an exemplary opened position. Referring to FIGS. 2 and 3, the cabinet 102 is illustrated in an open position, displaying components and product therein. For example, along a first wall 114 of the cabinet 102, a plurality of product storage columns 200 are positioned within the dispensing machine 100. Within each product storage column 200, a product 202 is storable for dispensing therefrom. A base 204 of each product storage column 200 is coupled to a respective ejector system 300 that facilitates dispensing the product 202 to the product retrieval channel 112. Ejector system 300 is described in further detail with respect to FIGS. 4-8 below.

In the exemplary embodiment, the product 202 is a consumable product such as a confectionary product, for example, chewing gum. Although product 202 is referred to herein as a confectionary product, the systems and methods described herein apply to other edible products or even to non-edible or non-food products. For example, in alternative embodiments, product 202 may be a different confectionary product, such as taffy, candy, mints, and/or chocolate. Furthermore, although product 202 is illustrated as a rectangular block, it is to be understood that product 202 may be any shape or configuration. During product packaging, discrete product pieces, for example, chewing gum chunks, may be individually wrapped. A plurality of these individually wrapped discrete product pieces may be coupled together in a wrapped unit package 206 (shown in FIG. 3). In some embodiments, these product packages 206 are stackable, creating a larger packaging block 208 (shown in FIG. 3 positioned for insertion into storage column 200) for transport. For example, block 208 illustrated in FIG. 3 includes two columns of product packages 206 with each column including multiple product packages 206 stacked on top of one another.

The product storage column 200 includes a first member 210 and a second member 212. The first member 210 has a substantially U-shaped cross-section. More specifically, the U-shaped cross-section is defined by a first side wall 214 opposing a second side wall 216. Each side wall 214 and 216 extends from the back wall 218 towards a front plane 224 opposite the back wall 218. The back wall 218, side walls 214 and 216, and the front plane 224 cooperate to define a product space 220 therewithin. The second member 212 is rotatably coupled, for example via at least one hinge 222, to the first side wall 214. The second member 212 is selectively positionable relative to the first member 210 between an opened position (as shown in FIG. 3) and a closed position (as shown in FIG. 2). The first member 210 is sized to receive the product 202 through the front plane 224 into the product space 220 when the second member 212 is in the opened position, and the second member 212 is sized to prevent movement of the product 202 through the front plane 224 when the second member 212 is in the closed position. For example, in the exemplary embodiment, the second member 212 in the closed position extends across the front plane 224 from the first side wall 214 and engages with the second side wall 216. Alternatively, the second member 212 in the closed position extends to any suitable extent proximate the front plane 224 that enables the second member 212 to function as described herein.

For example, to re-stock product 202 within dispensing machine 100, the product storage column 200 is opened by rotating the second member 212 away from the second side wall 216, exposing substantially the entire product space 220 along the length of the first member 210. At least one package block 208 is inserted within the product space 220 of the first member 210 through the front plane 224. The first member 210 is sized to receive the product 202 through the front plane 224 of the product column 200 into the product space 220. Once the product 202 is positioned within the first member 210, the product column 200 is closed by rotating the second member 212 towards the second side wall 216 and enclosing the product 202 within. The second member 212 is sized to prevent movement of the product 202 through the front plane 224 when the second member is in the closed position.

By stocking the product packages 206 through the front plane 224 of the product column 200, multiple package blocks 208 may be inserted at one time, thus tending to reduce stocking time of dispensing machine 100. Furthermore, stocking the package blocks 208 through the front of the product column 200 ensures that the product 202 is not skewed when the product is at the base 204 of the product column 200, thus tending to improve the operability of dispensing machine 100. Moreover, to assist in stocking, a window 226 may be positioned within one of the side walls 214 and 216 and/or the second member 212 to provide a visual indication of how much product 202 is within the product column 200.

Figure 4:
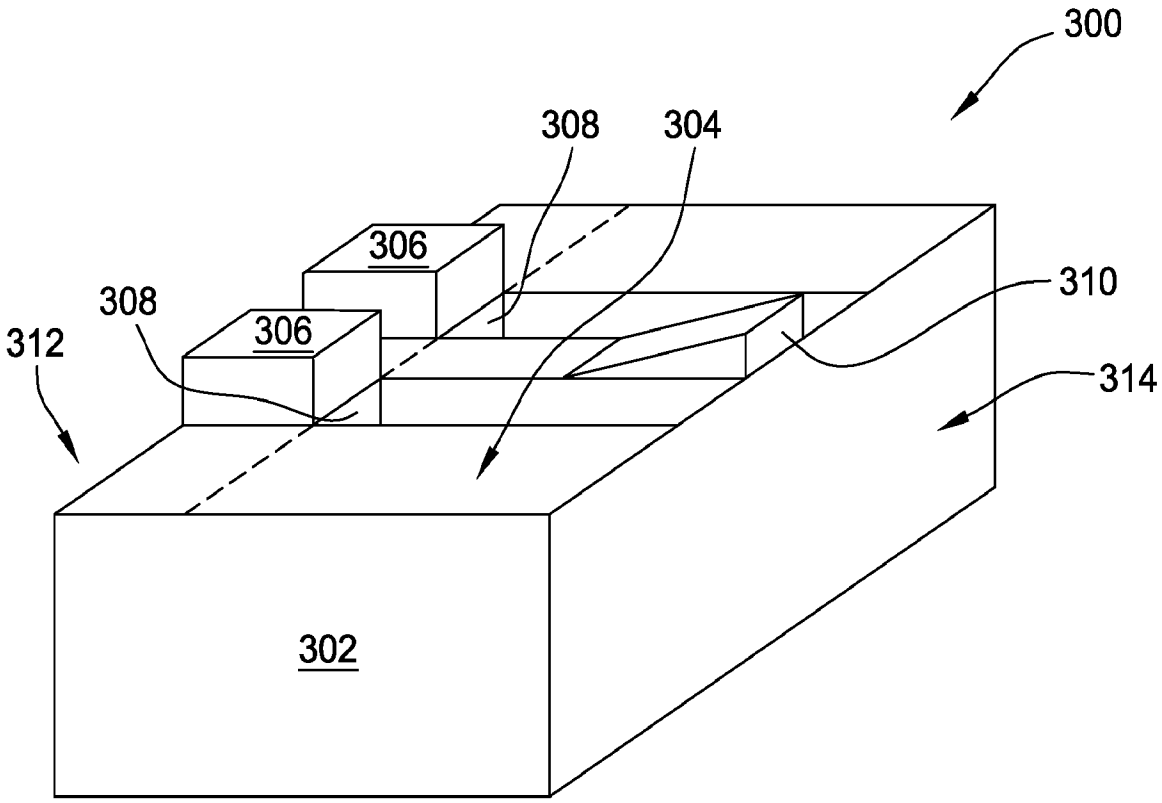
FIG. 4 is a perspective view of an exemplary ejector system that may be used with the dispensing machine shown in FIG. 1.

FIG. 4 is a perspective view of an exemplary embodiment of the ejector system 300 that may be used with the dispensing machine 100 (shown in FIG. 1). In the exemplary embodiment, the ejector system 300 is coupled to the product column base 204 (shown in FIGS. 2-3). The ejector system 300 includes a support base 302 including a support surface 304. Specifically, the product column 200 (shown in FIGS. 2-3) is coupled above the support surface 304. The ejector system 300 further includes a first dispensing block 306 movably coupled to the support base 302 and an adjacent second dispensing block 308 also movably coupled to the support base 302. In the exemplary embodiment, two sets of dispensing blocks 306 and 308, one forward set and one rear set, are illustrated. In alternative embodiments, ejector system 300 may include any suitable number of sets of dispensing blocks 306 and 308, such as one set. Additionally, the ejector system 300 includes a switch 310 coupled to the support base 302. In the exemplary embodiment, the switch 310 is located between the two sets of dispensing blocks. The switch 310 is signals whether the product 202 is disposed adjacent the support surface 304 and within product column 200.

In the exemplary embodiment, the unit product package 206 (shown in FIGS. 2-3) within the product column 200 and disposed adjacent the support surface 304 may be ejected therefrom on a side of the ejector system 300. Specifically, each of the first and second dispensing blocks 306 and 308 are selectively positionable within the support base 302 relative to the support surface 304. Each of the first and second dispensing blocks 306 and 308 are movable through a cycle of positions from a home side 312 of the support base 302 to a dispensing side 314 of the support base 302, and then back to the original positions on the home side 312, to eject a series of unit product packages 206 from the bottom of the product storage column 200 and to permit additional unit packages 206 to fill in adjacent the support surface 304 from above. FIGS. 5-8 described below illustrate an exemplary cycle of positions of the ejector system 300. For example, each of the first and second dispensing blocks 306 and 308 are movable between a home position 316 (shown in FIG. 5), a first dispensing position (shown in FIG. 6), a second dispensing position (shown in FIG. 7), a refill position (shown in FIG. 8), and back to the home position 316.

Figure 5:
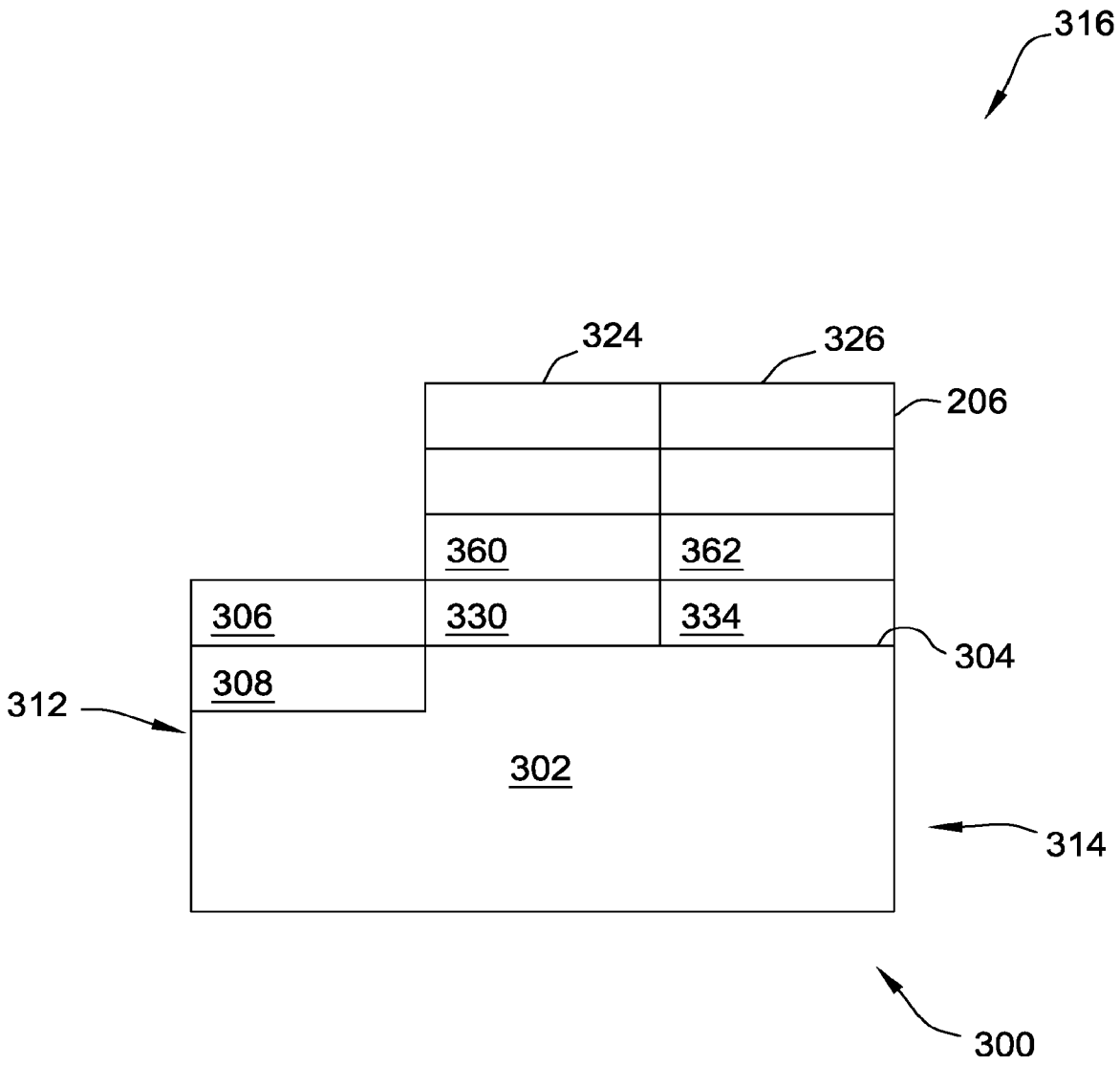
FIG. 5 is a schematic view of the ejector system shown in FIG. 4 in an exemplary home position.

FIG. 5 is a schematic view of the ejector system 300 (shown in FIG. 4) in an exemplary home position 316. In the exemplary embodiment, the support surface 304 is configured to receive a first column 324 and a second column 326 of product packages 206 adjacent the support surface 304. Further, the first dispensing block 306 is stacked on top of the second dispensing block 308 proximate the home side 312 of the support base 302, and adjacent the first and second product package columns 324 and 326. The first dispensing block 306 is positioned above the support surface 304 while the second dispensing block 308 is below the support surface 304. Each of the first and second dispensing blocks 306 and 308 may be sized to substantially correspond to the size of the product package 206. For example, a height and width of the dispensing blocks 306 and 308 may be substantially similar to a height and width of the product package 206. In the embodiment of FIG. 5, an overall width of the support base 302 is approximately three times the size of the width of the product package 206.

Figure 6:
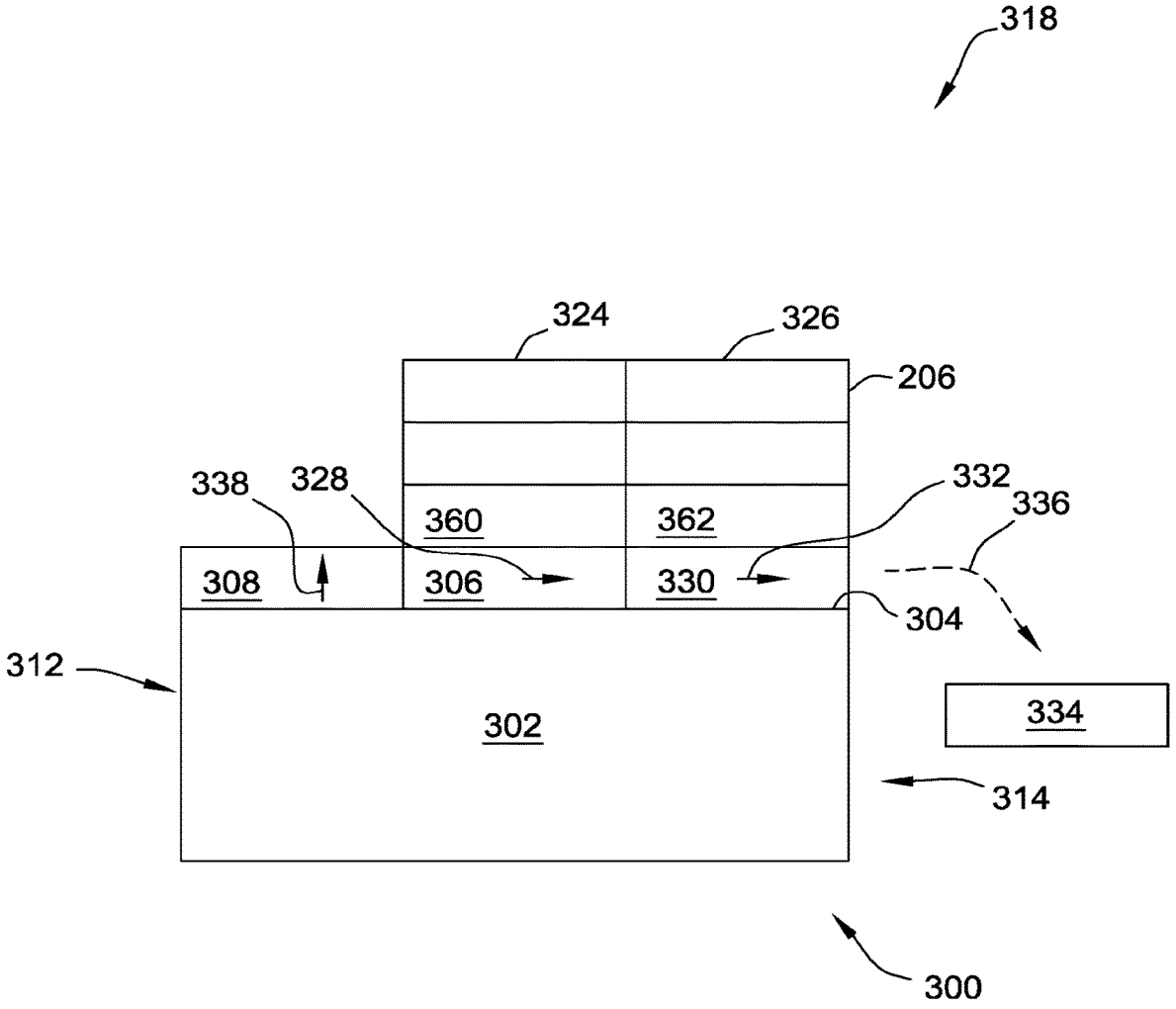
FIG. 6 is a schematic view of the ejector system shown in FIG. 4 in an exemplary first dispensing position.

FIG. 6 is a schematic view of the ejector system 300 (shown in FIG. 4) in an exemplary first dispensing position 318. From the home position 316 (shown in FIG. 5) the first dispensing block 306 is moved 328 along the support surface 304 and into the first package column 324 such that a second product package 330 from the first product package column 324 is pushed/moved 332 into the second product package column 326 and a first product package 334 from the second product package column 326 is ejected 336 on the dispensing side 314 and towards the product retrieval channel 112 (shown in FIG. 1) for a consumer to retrieve. Further, the second dispensing block 308 is moved 338 adjacent to the first dispensing block 306 and above the support surface 304.

As the first dispensing block 306 moves 328 toward the dispensing side 314, the block 306 replaces the second product package 330 at a base of the first product package column 324, such that the remainder of first product package column 324 does not move vertically. Furthermore, the second product package 330 replaces the first product package 334 at a base of the second product package column 326, such that the remainder of second product package column 326 does not move vertically. Maintaining the vertical placement of the first and second product package columns 324 and 326 tends to reduce or eliminate skewing of the remaining product packages 206 within the product storage column 200 (shown in FIGS. 2-3), thus facilitating reliable operation of the machine 100. Additionally, the ejector system 300 facilitates the use of two product package stacks or columns of the product 202, thus increasing a capacity of product storage column 200 without need for a second ejector module and reducing stocking frequency, while still ejecting a single package 206 to the consumer.

Furthermore, in some embodiments, product packages 206, such as first product package 334, are ejected from the dispensing side 314 of the ejector system 300 that is not at the front of the dispensing machine 100 (see FIGS. 1-3). In the exemplary embodiment, ejector system 300 is positioned within the dispensing machine 100 such that the home side 312 and dispensing side 314 are substantially parallel to the first and second side walls 214 and 216 (shown in FIGS. 2-3) of the product column 200. As such, the first product package 334 is not ejected towards the front consumer interface 104 (shown in FIG. 1) and is instead ejected from a side of product column 200. By not ejecting product from the front of the product column 200, no extra space in machine 100 is needed to enable ejected product packages 206 to clear a front plate. The side ejection direction tends to allow the dispensing machine 100 to have a reduced front-to-back width and be much slimmer, thus reducing an overall footprint of the machine 100 and allowing the machine 100 to be placed in more areas.

Figure 7:
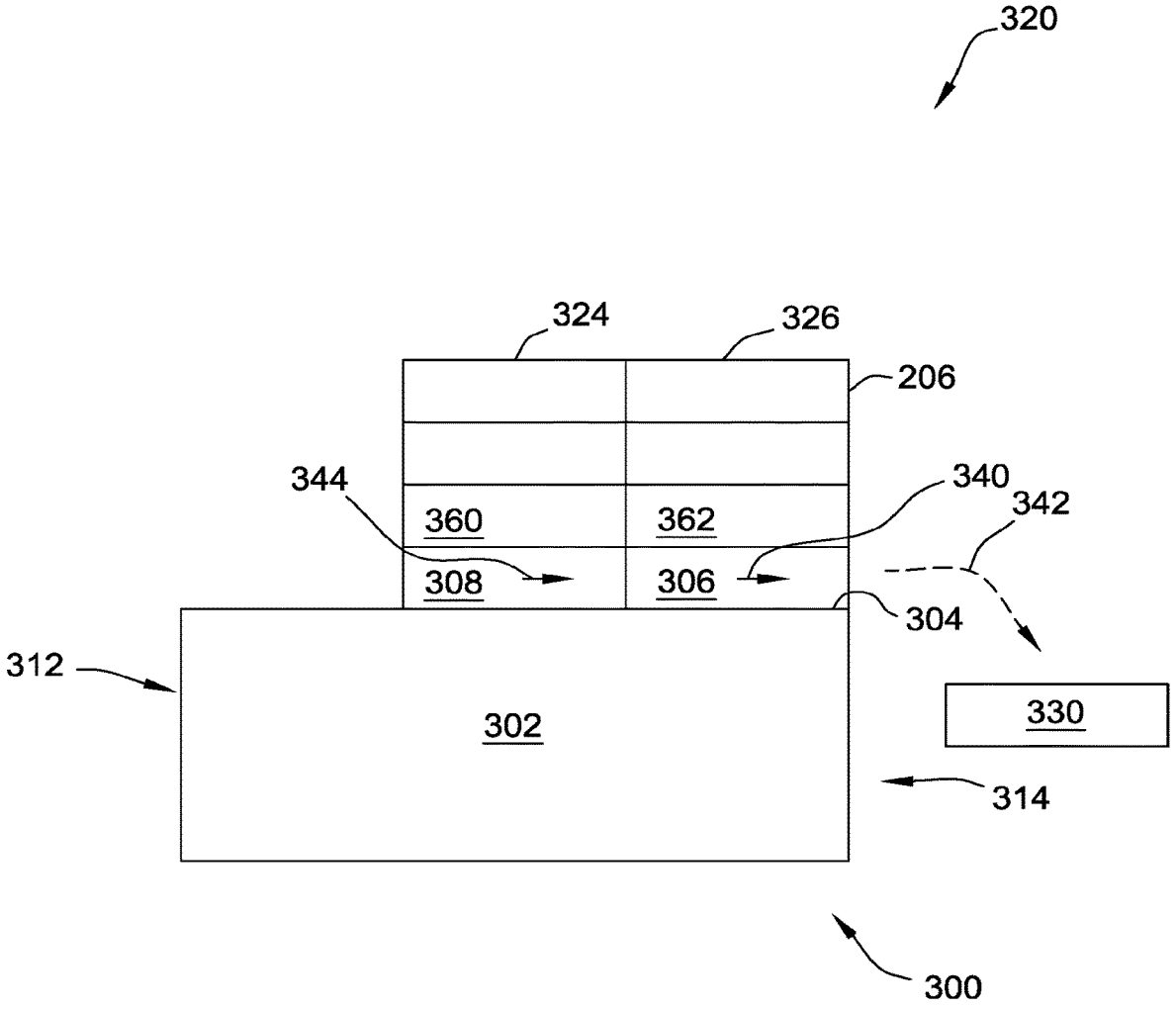
FIG. 7 is a schematic view of the ejector system shown in FIG. 4 in an exemplary second dispensing position.

FIG. 7 is a schematic view of the ejector system 300 (shown in FIG. 4) in an exemplary second dispensing position 320. From the first dispensing position 318 (shown in FIG. 6), the first dispensing block 306 is moved 340 further along the support surface 304 and into the second product package column 326 such that the second product package 330 is ejected 342 on the dispensing side 314 and towards the product retrieval channel 112 (shown in FIG. 1) for a consumer to retrieve. Further, the second dispensing block 308 is moved 344 along the support surface 304 adjacent to the first dispensing block 306 and into the first package column 324.

As the first dispensing block 306 moves 340 toward the dispensing side 314, the block 306 replaces the second product package 330 at the base of second column 326, such that the remainder of second column 326 does not move vertically. Furthermore, the second dispensing block 308 replaces the first dispensing block 306 at the base of first column 324 such that the remainder of first column 324 does not move vertically. Maintaining the vertical placement of the first and second columns 324 and 326 again tends to avoid skewing of the product packages 206 within the product storage column 200 (shown in FIGS. 2-3).

It should be understood that, in alternative embodiments, a plurality of unit product packages 206 are stacked in more than two columns, ejector system 300 includes a corresponding additional number of dispensing blocks, and the dispensing blocks are configured to cycle through a corresponding additional number of dispensing positions.

Figure 8:
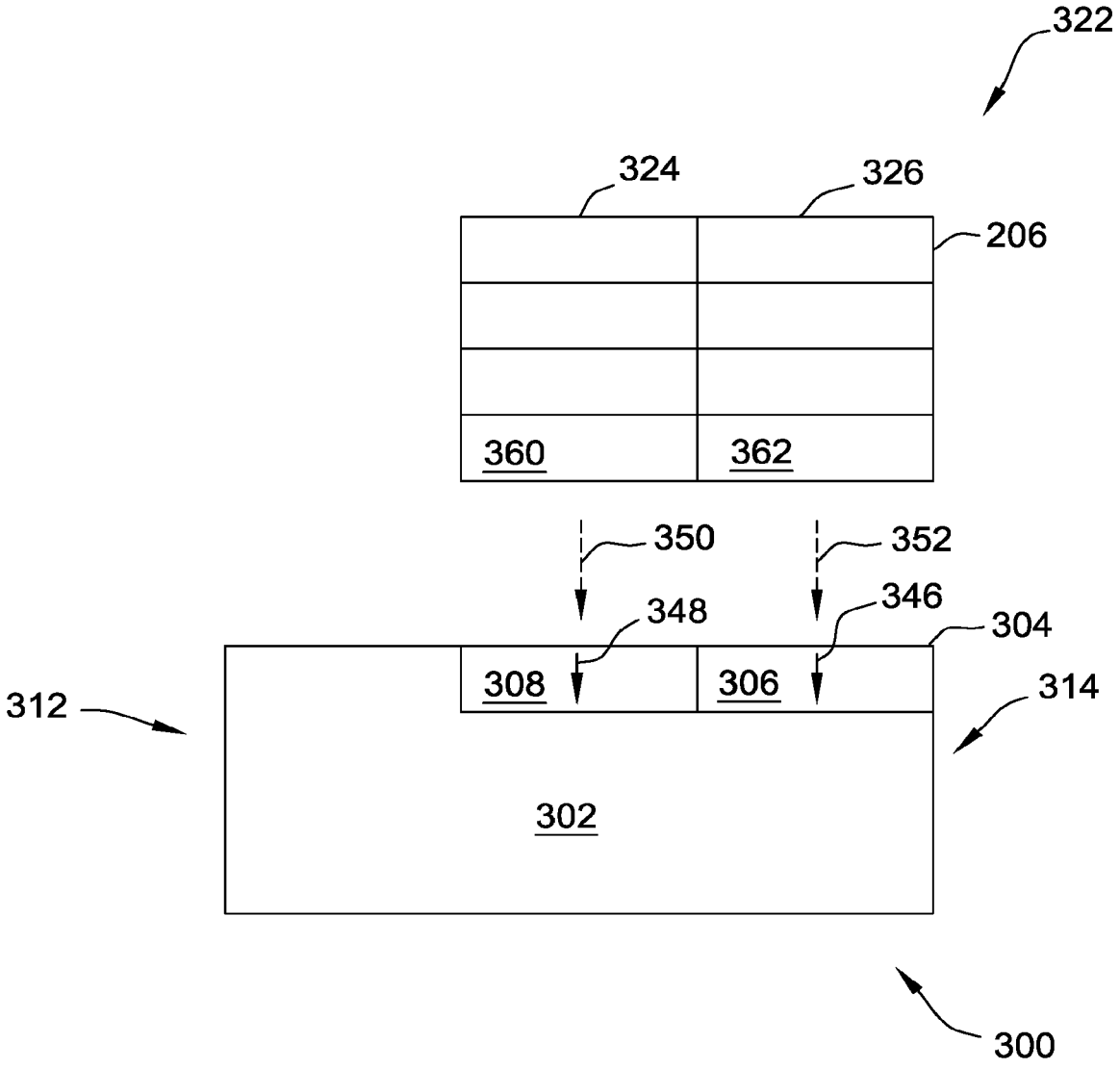
FIG. 8 is a schematic view of the ejector system shown in FIG. 4 in an exemplary refill position.

FIG. 8 is a schematic view of the ejector system 300 (shown in FIG. 4) in an exemplary refill position 322. From the second dispensing position 320 (shown in FIG. 7) the first and second dispensing blocks 306 and 308 are moved 346 and 348 below the support surface 304 of the support base 302. As such, a third product package 360 from the first product package column 324 and a fourth product package 362 from the second product package column 326 move/drop vertically down 350 and 352 to a position adjacent the support surface 304, and the remaining product packages 206 in columns 324 and 326 move down together correspondingly. Causing first and second columns 324 and 326 to move simultaneously towards the support surface 304 tends to reduce skewing of the product packages 206 within the product storage column 200 (shown in FIGS. 2-3), facilitating reliable operation of the machine 100. After the refill position 322, the first and second dispensing blocks 306 and 308 are moved to the home position 316 (shown in FIG. 5) to repeat the cycle again.

The advantages and benefits of the inventor are now believed to have been amply demonstrated in the exemplary embodiments disclosed.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An ejector system for a dispensing machine comprising:

a support base including a support surface configured to receive a first and a second column of product packages adjacent the support surface;

a first dispensing block sized to substantially correspond to a size of a product package to be dispensed, the first dispensing block movably coupled to the support base; and a second dispensing block sized to substantially correspond to the size of the product package, the second dispensing block movably coupled to the support base adjacent to the first dispensing block, wherein each of the first and second dispensing blocks is selectively moved through a cycle of positions including positions above the support surface, the first product package column, and the second product package column to eject a series of the product packages from the first and second product package columns.

2. The ejector system of claim 1, wherein in a first position, the first and second dispensing blocks are in a stacked relationship adjacent to the first product package column, the first dispensing block above the support surface and the second dispensing block below the support surface.

3. The ejector system of claim 1, wherein in a second position, the first and second dispensing blocks are in side-by-side relationship above the support surface, the first dispensing block within the first product package column, such that the first dispensing block is operable to eject a first product package from the second product package column and to reposition a second product package from the first product package column into the second product package column.

4. The ejector system of claim 3, wherein in a third position the first and second dispensing blocks are in a side-by-side relationship above the support surface, the second dispensing block within the first product package column and the first dispensing block within the second product package column, such that the first dispensing block is operable to eject the second product package from the second product package column.

5. The ejector system of claim 4, wherein in a fourth position the first and second dispensing blocks are in a side-by-side relationship below the support surface, such that a third product package from the first product package column and a fourth product package from the second product package column are moved to adjacent the support surface.

6. The ejector system of claim 1, wherein a width of the support base is sized to be approximately three times a width of the first dispensing block.

7. The ejector system of claim 1, further comprising a switch coupled to the support base that is configured to signal whether a product is disposed on the support surface.

8. An ejector system for a dispensing machine comprising:

a support base including a support surface configured to receive a first and a second column of product packages adjacent the support surface;

a first dispensing block sized to substantially correspond to a size of a product package to be dispensed, the first dispensing block movably coupled to the support base; and a second dispensing block sized to substantially correspond to the size of the product package, the second dispensing block movably coupled to the support base adjacent to the first dispensing block, wherein each of the first and second dispensing blocks is selectively positionable through a cycle of positions relative to the support surface to eject a series of the product packages from the first and second product package columns, wherein each of the first and second dispensing blocks is selectively positionable relative to the support surface between at least a home position, a first dispensing position, a second dispensing position, and a refill position, wherein the first dispensing position includes the first and second dispensing blocks in side-by-side relationship above the support surface, the first dispensing block within the first product package column, such that the first dispensing block is operable to eject a first product package from the second product package column and to reposition a second product package from the first product package column into the second product package column.

9. An ejector system for a dispensing machine comprising:

a support base including a support surface configured to receive a first and a second column of product packages adjacent the support surface;

a first dispensing block sized to substantially correspond to a size of a product package to be dispensed, the first dispensing block movably coupled to the support base; and a second dispensing block sized to substantially correspond to the size of the product package, the second dispensing block movably coupled to the support base adjacent to the first dispensing block, wherein each of the first and second dispensing blocks is selectively positionable through a cycle of positions relative to the support surface to eject a series of the product packages from the first and second product package columns, wherein each of the first and second dispensing blocks is selectively positionable relative to the support surface between at least a home position, a first dispensing position, a second dispensing position, and a refill position, wherein the first dispensing position includes the first and second dispensing blocks in side-by-side relationship above the support surface, the first dispensing block within the first product package column, such that the first dispensing block is operable to eject a first product package from the second product package column and to reposition a second product package from the first product package column into the second product package column, and wherein the second dispensing position includes the first and second dispensing blocks in side-by-side relationship above the support surface, the second dispensing block within the first product package column and the first dispensing block within the second product package column, such that the first dispensing block is operable to eject the second product package from the second product package column.

10. An ejector system for a dispensing machine comprising:

a support base including a support surface configured to receive a first and a second column of product packages adjacent the support surface;

a first dispensing block sized to substantially correspond to a size of a product package to be dispensed, the first dispensing block movably coupled to the support base; and a second dispensing block sized to substantially correspond to the size of the product package, the second dispensing block movably coupled to the support base adjacent to the first dispensing block, wherein each of the first and second dispensing blocks is selectively positionable through a cycle of positions relative to the support surface to eject a series of the product packages from the first and second product package columns, wherein each of the first and second dispensing blocks is selectively positionable relative to the support surface between at least a home position, a first dispensing position, a second dispensing position, and a refill position, wherein the first dispensing position includes the first and second dispensing blocks in side-by-side relationship above the support surface, the first dispensing block within the first product package column, such that the first dispensing block is operable to eject a first product package from the second product package column and to reposition a second product package from the first product package column into the second product package column, wherein the second dispensing position includes the first and second dispensing blocks in side-by-side relationship above the support surface, the second dispensing block within the first product package column and the first dispensing block within the second product package column, such that the first dispensing block is operable to eject the second product package from the second product package column, and wherein the refill position includes the first and second dispensing blocks in side-by-side relationship below the support surface, such that a third product package from the first product package column and a fourth product package from the second product package column are moved to adjacent the support surface.

11. An ejector system for a dispensing machine comprising:

a support base including a support surface configured to receive a first and a second column of product packages adjacent the support surface;

a first dispensing block sized to substantially correspond to a size of a product package to be dispensed, the first dispensing block movably coupled to the support base; and a second dispensing block sized to substantially correspond to the size of the product package, the second dispensing block movably coupled to the support base adjacent to the first dispensing block, wherein each of the first and second dispensing blocks is selectively positionable through a cycle of positions relative to the support surface to eject a series of the product packages from the first and second product package columns, wherein each of the first and second dispensing blocks is selectively positionable relative to the support surface between at least a home position, a first dispensing position, a second dispensing position, and a refill position, and wherein the home position includes the first and second dispensing blocks in a stacked relationship adjacent to the first product package column, the first dispensing block above the support surface and the second dispensing block below the support surface.

* * * * *